US006934968B2

(12) United States Patent
Kurpis

(10) Patent No.: US 6,934,968 B2
(45) Date of Patent: Aug. 30, 2005

(54) ABSORBENT NECK SHIELD

(76) Inventor: Albert J. Kurpis, 30 Werimus Rd., Saddle River, NJ (US) 07450

( * ) Notice: Subject to any disclaimer, the term of this patent is extended or adjusted under 35 U.S.C. 154(b) by 3 days.

(21) Appl. No.: 10/716,150

(22) Filed: Nov. 17, 2003

(65) Prior Publication Data

US 2004/0139533 A1 Jul. 22, 2004

Related U.S. Application Data

(60) Provisional application No. 60/426,720, filed on Nov. 15, 2002.

(51) Int. Cl.[7] ..... A41D 13/04; A41B 13/10

(52) U.S. Cl. ..... 2/49.1; 2/49.4; 2/50

(58) Field of Search ..... 2/50, 52, 48, 60, 2/174, 170, 2.15, 468, 457, 46, 49.1–49.5, 51, 114, 135, 136, 129, 901

(56) References Cited

U.S. PATENT DOCUMENTS

| | | | | | |
|---|---|---|---|---|---|
| 162,170 | A | | 4/1875 | Horton | |
| 1,243,462 | A | * | 10/1917 | Troiano | 2/50 |
| 1,506,332 | A | | 8/1924 | Bloom | |
| 1,592,283 | A | | 7/1926 | McKenzie | |
| 2,080,107 | A | * | 5/1937 | Brandstein | 2/50 |
| 2,116,685 | A | * | 5/1938 | Nicolet | 2/50 |
| 2,544,487 | A | * | 3/1951 | Caluthis | 2/50 |
| 2,629,870 | A | | 3/1953 | Hudson | |
| 2,638,599 | A | * | 5/1953 | Flink | 2/170 |
| 2,778,024 | A | * | 1/1957 | Randolph | 2/50 |
| 2,851,690 | A | * | 9/1958 | Jennings | 2/50 |
| 3,597,763 | A | | 8/1971 | Bienvenu | |
| 3,798,674 | A | * | 3/1974 | Daniel | 2/50 |
| 4,365,351 | A | * | 12/1982 | Doerschuk et al. | 2/2.15 |
| 4,764,986 | A | * | 8/1988 | Stewart | 2/115 |
| 4,980,927 | A | * | 1/1991 | Wawiluk et al. | 2/60 |
| 5,136,721 | A | * | 8/1992 | Farnworth et al. | 2/2.17 |
| 5,230,100 | A | * | 7/1993 | Lock-Jones | 2/50 |
| 5,479,662 | A | | 1/1996 | Runco | |
| 5,509,141 | A | | 4/1996 | Saltzman | |
| 5,555,561 | A | | 9/1996 | Plachta et al. | |
| 5,572,740 | A | * | 11/1996 | Geniesse | 2/46 |
| 5,647,059 | A | * | 7/1997 | Uglene et al. | 2/2.15 |
| 5,651,140 | A | * | 7/1997 | Gibson | 2/46 |
| 5,671,479 | A | | 9/1997 | Dedrick | |
| 5,930,837 | A | | 8/1999 | Anvar | |
| 5,956,763 | A | | 9/1999 | Blackshear | |
| 5,996,119 | A | * | 12/1999 | Anderberg | 2/50 |
| RE36,868 | E | | 9/2000 | Fisher et al. | |
| RE36,924 | E | | 10/2000 | Fisher et al. | |
| 6,182,290 | B1 | | 2/2001 | Morris | |
| 2004/0049828 | A1 | * | 3/2004 | Moses | 2/50 |

OTHER PUBLICATIONS

International Search Report dated Oct. 12, 2004 for International Application No. PCT/US03/36834.

* cited by examiner

*Primary Examiner*—Amy B. Vanatta
(74) *Attorney, Agent, or Firm*—Cohen, Pontani, Lieberman & Pavane

(57) ABSTRACT

A wrap-around absorbent shield forms a semi-tight seal with the flesh of a subject, where at least a part of the shield at the semi-tight seal is made of an absorbent material. The combination of the absorbent material and the semi-tight seal substantially prevents the flow of material past the semi-tight seal without causing discomfort to the subject.

13 Claims, 8 Drawing Sheets

ABSORBENT NECK SHIELD

RELATED APPLICATIONS

This application claims priority under 35 U.S.C. §119(e) from U.S. Provisional Patent Application Ser. No. 60/426,720 which was filed on Nov. 15, 2002, and which is incorporated by reference in its entirety.

BACKGROUND OF THE INVENTION

1. Field of the Invention

This invention relates to a wrap-around absorbent shield for preventing contamination and/or leakage, and, more particularly, to an absorbent neck sponge.

2. Description of the Related Art

It is useful in many undertakings to have the ability to prevent liquids or semi-liquid substances that are present on one part of one's body from leaking to or contaminating another part of one's body. An example of such an undertaking is when the inside of one's mouth is being manipulated during an examination and/or procedure performed by a dentist, oral surgeon, periodontist, and/or dental hygienist. In such a situation, it is common for fluids, such as saliva and/or blood, to flow out from the mouth or a combination of solids and fluids to spray or spew from the mouth. Another example of an undertaking that requires such protection is the eating of messy foods (or the eating of foods by those who are messy, e.g., children, babies, and the mentally or physically impaired). Yet another example of a task which requires protection from fluids is hairdressing or hair coloring, where various noxious fluids are applied to one portion of the body, but such fluids may cause harm or discomfort if they flow to other parts of the body. Still another example of a task that may require protection from fluids is a dermatological procedure where a chemically active substance is being applied to a portion of one's skin. A further example is when one has a wound and/or covering of a wound or medical condition, such as a cast, which must be protected from dampness or from getting soaked in the rain.

There are a myriad of circumstances in which one may wish to protect a portion of one's body from the flow of fluids from another portion of one's body and/or from the general environment. One common solution for protecting oneself from leakage and/or contamination from fluids is the bib or apron, which are typically used to protect one from, for example, food one is eating or contaminants from a dental procedure. There are numerous examples of typical leakage and/or contamination prevention means in the prior art, both for food and for dental procedures.

U.S. Pat. No. 5,852,849 to Lansing et al. shows the typical dental procedure bib, with a novel means for fastening the bib around the patient's neck. This conventional means leaves a large portion of the neck and upper chest unprotected from either substances that may flow down the patient's neck or substances sprayed or spewed forth from the patient's mouth. On the other hand, U.S. Pat. No. 4,969,473 to Bothwell describes a means which prevents contamination of the neck by covering the entire head of a dental patient with a hood, except for a hole for the patient's mouth. This contamination prevention means is bit severe, and may make the patient feel too constrained, if not entombed.

U.S. Pat. No. 2,629,870 to Hudson shows a typical infant's bib, in a novel cardioidal shape, which is tied by strips of fabric in the back. While certainly useful, such a bib does not create a seal between the bib and the baby's neck, thereby allowing fluids, semi-fluids, and/or fluids and solids to seep past the point where the bib is tied around the infant's neck. If one attempts to tie the bib tightly enough to prevent seepage, it could be uncomfortable for the infant, and possibly dangerous.

As shown above, typical leakage and/or contamination prevention means do not provide a comfortable apparatus to prevent the flow of materials past the point of attachment on the subject's body.

Therefore, there is a need for a device to stop the flow of any fluids, semi-fluids, and/or fluids and solids from sliding past a certain point of the subject's body.

SUMMARY OF THE INVENTION

An objective of the present invention is to provide a device for preventing liquids, semi-liquids, and/or combinations of liquids and solids that are present on one part of one's body from leaking to or contaminating another part of one's body. The term "semi-liquid" is used herein to refer to any substance that fits somewhere in the spectrum between solids and liquids, where such a substance is capable of some manner of "flowing" from one location on the subject's body to another location on the subject's body.

The present invention provides a wrap-around absorbent shield which creates a seal with the flesh of the subject in order to prevent any fluids, semi-fluids, and/or fluids and solids from sliding past the point of the seal, where at least a part of the surface forming the semi-tight seal comprises an absorbent material. The combination of the absorbent material and the semi-tight seal substantially prevents the flow of material past the semi-tight seal without causing discomfort to the subject.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
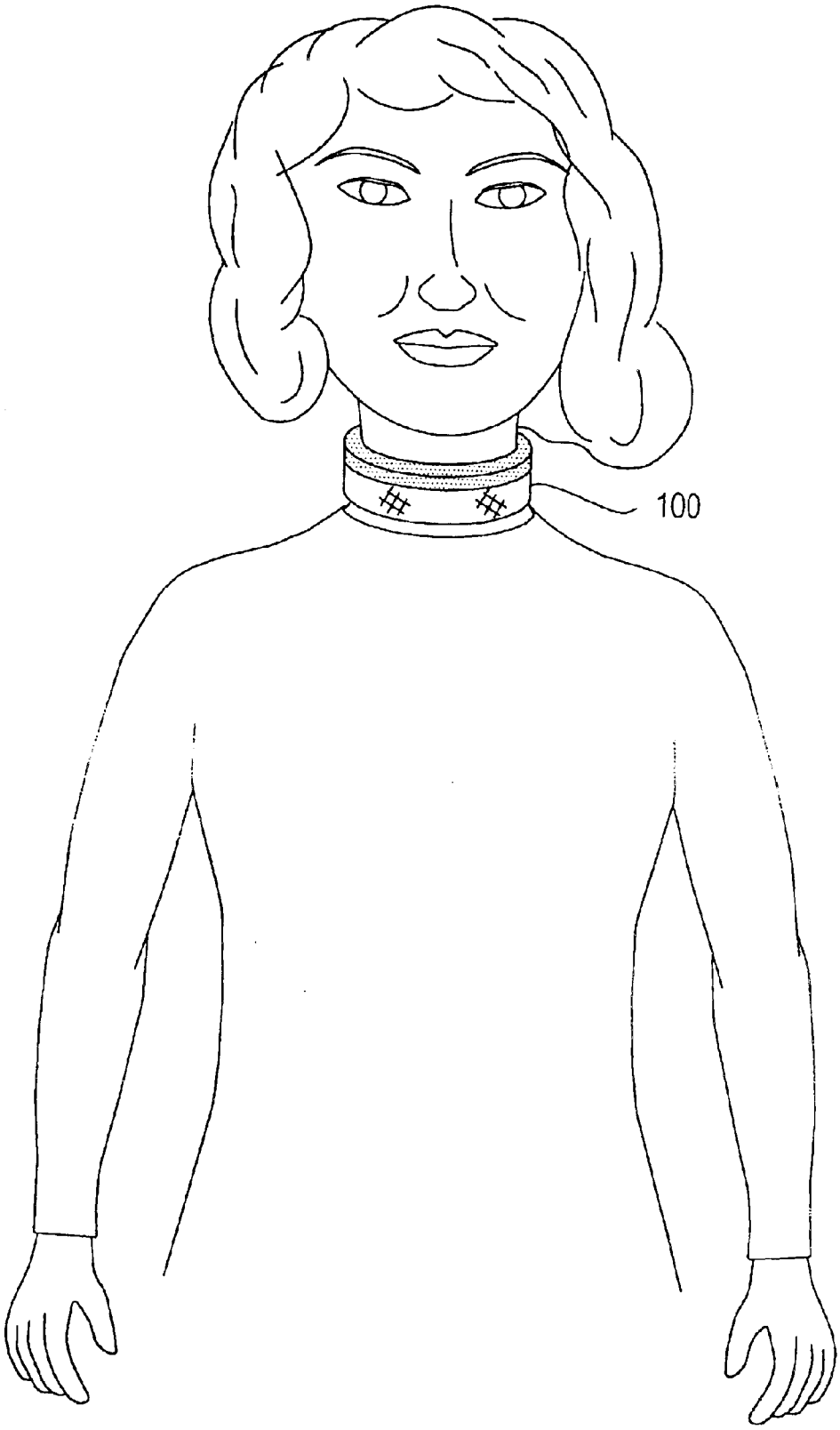
FIG. 1 is a drawing of an absorbent neck shield placed on the neck of a subject according to a preferred embodiment of the present invention.

The presently preferred embodiment of the invention comprises an absorbent wrap-around neck shield. As shown in FIG. 1, the absorbent neck shield wraps around the neck of an individual and creates a seal with the flesh of the neck in order to prevent any fluids, semi-fluids, and/or fluids and solids from sliding down the neck past the point of the seal. This seal is tight enough to prevent flow, yet not so tight as to cause discomfort to the flesh of the subject.

The shield itself may be made of any material, or combination of materials, which can maintain a semi-tight yet not uncomfortable seal with the flesh of the subject, while also retaining moisture (and/or blocking its flow past the semi-tight seal). Exemplary materials for forming the absorbent neck shield include absorbent paper, foam, (natural or artificial) sponge, a polymer, or any other material which can both maintain a semi-tight seal with the flesh of a subject's body part and retain moisture and/or prevent its flow past the semi-tight seal. Furthermore, any material and/or structure which prevents a flow of material from one portion of one's body to another portion of one's body may be used in accordance with the present invention, including, for example, any structure and/or material which diverts the flow in a lateral direction.

Figure 2A:
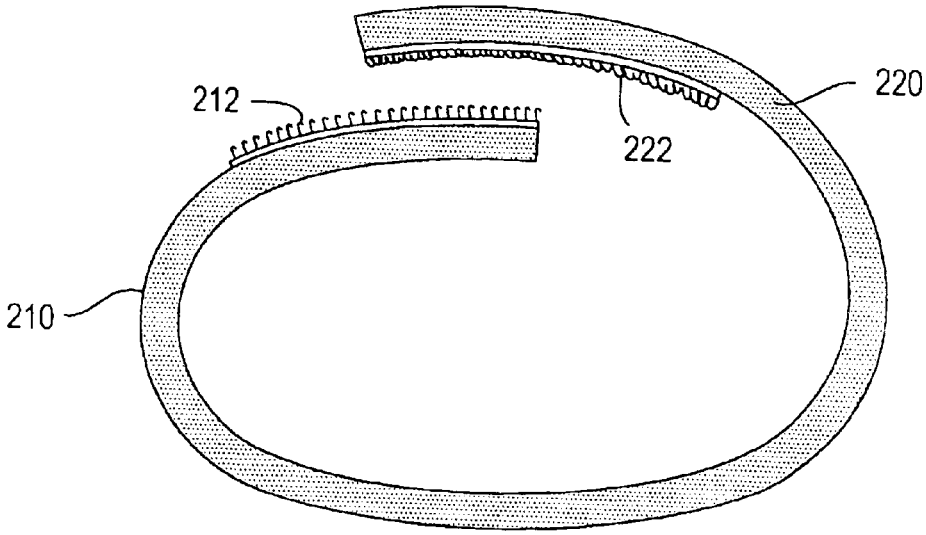
FIGS. 2A and 2B are drawings of an absorbent neck shield which use two different exemplary fastening means according to a preferred embodiment of the present invention.

Different modes of fastening or fixing the absorbent neck shield to the neck are contemplated. One exemplary fastening mode is shown in FIG. 2A, in which the absorbent neck shield comprises an incomplete circular form whose two ends 210 and 220 have opposite hook and fastener means, such as VELCRO™ strips 212 and 222. VELCRO™ strips 212 and 222 are incorporated into the sides of the ends 210 and 220, respectively, so that when the ends 210 and 220 of the shield overlap, the strips 212 and 222 in ends 210 and 220 can be fastened together. The amount of overlap can be varied by the user, thereby adjusting the size of the neck shield to fit the neck of the subject in the appropriate manner.

Figure 2B:
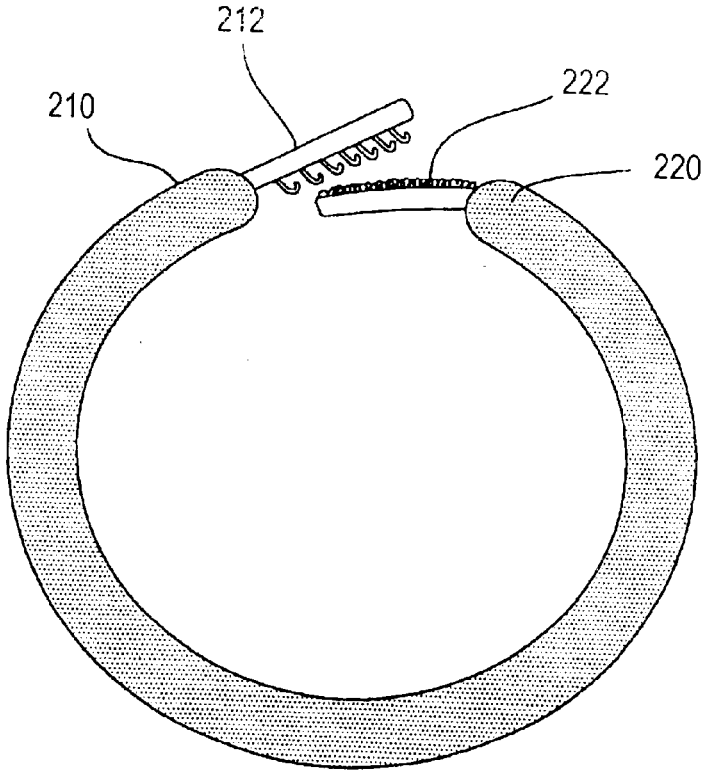

Another exemplary fastening mode is shown in FIG. 2B, in which the absorbent neck shield comprises an incomplete circular form whose two ends 210 and 220 have opposite VELCRO™ strips 212 and 222. Rather than attaching the VELCRO™ strips 212 and 222 to the sides the neck shield as is done in FIG. 2A, the two VELCRO™ strips 212 and 222 in FIG. 2B are attached to the end tips of ends 210 and 220 of the neck shield. In the neck shield of FIG. 2B, VELCRO™ strips 212 and 222 are positioned at the front or back of the subject's neck, and, when strips 212 and 222 are fastened, the two ends 210 and 220 of the absorbent neck shield of FIG. 2B do not touch one another, but rather there is more or less distance between them, depending on the size of the neck of the subject. In the neck shield of either FIG. 2A or FIG. 2B. VELCRO™ strips 212 and 222 are preferably fasten together after the neck shield has been placed around the neck of the subject.

Although VELCRO™ strips are used as the fastening means in the embodiment shown in FIGS. 2A and 2B, other embodiments may use a variety of means. For example, the ends 210 and 220 of the absorbent neck shield could have button tabs or snaps attached, or strips of fabric that are tied together in order to fasten the absorbent neck shield.

Figure 3:
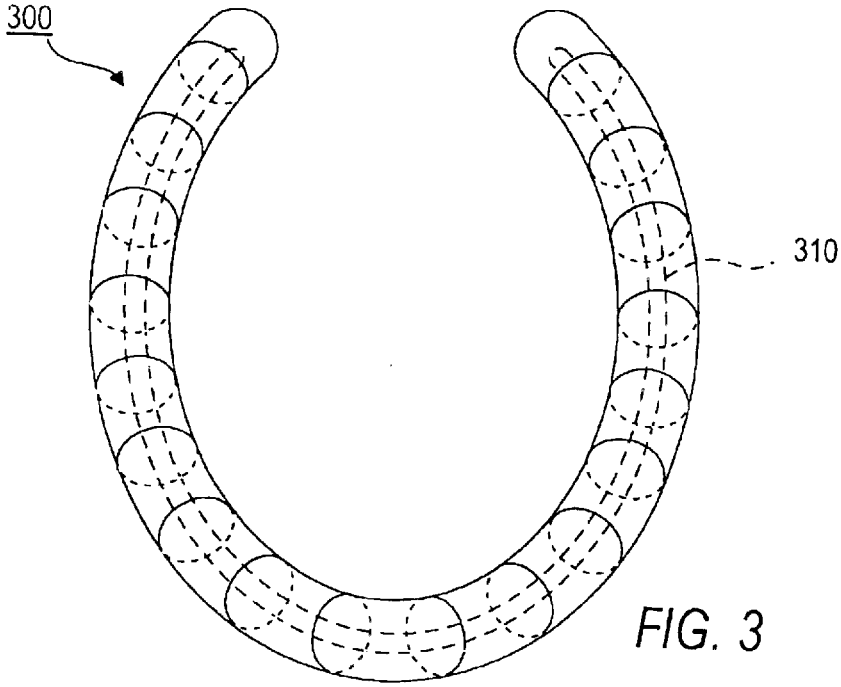
FIG. 3 is a drawing of an absorbent neck shield which uses a resilient member to form a seal with the neck of the subject according to a preferred embodiment of the present invention.

Yet another exemplary fastening mode is shown in FIG. 3, in which a member 310 forms an internal "backbone" to the absorbent neck shield 300. The material (or combination of materials) forming member 310 has "memory", in the sense that member 310 will always maintain a general circular or horseshoe shape, yet it is also pliable enough to accommodate the different neck sizes of particular subjects. Thus, it could be a metal wire or a polymer.

Member 310 is preferably in the center of the 'tube' forming the circular shield 300; however, in other embodiments, 'backbone' member 310 may be located anywhere in which it can still perform its function of keeping the horseshoe or circular shape, including being attached to the outside of the tube. Furthermore, rather than a resilient 'backbone' member, a frame or lattice (either internal or external) could be used.

Figure 4:
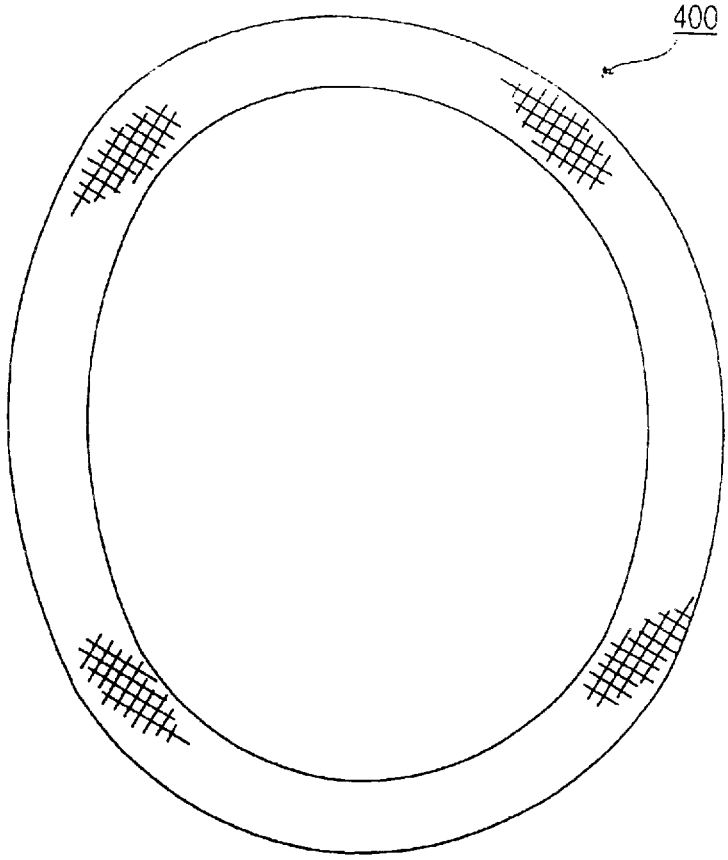
FIG. 4 is a drawing of an absorbent neck shield, wherein the elasticity of the material of the absorbent neck shield forms a seal with the neck of the subject according to a preferred embodiment of the present invention.

Still another exemplary fastening mode is shown in FIG. 4, in which absorbent neck shield 400 forms a complete circular or oval shape. In this embodiment, the absorbent neck shield 400 is made of a material which is both absorbent and elastic. The elasticity of the material forming the neck shield 400 is such that the shield 400 may be stretched to fit over the subject's head and still retain enough resiliency to form a seal with the subject's neck. On the other hand, the material forming the neck shield 400 must also be pliable enough not to form such a tight seal as to cause discomfort to the subject.

As shown by the above embodiments, any means of maintaining a semi-tight seal with the flesh of the subject is within the purview of the present invention. Furthermore, any combination of fastening or affixing means is contemplated. For example, both the resilient member of FIG. 3 and the fastening means of FIGS. 2A and 2B could be used in an embodiment according to the present invention.

Figure 5:
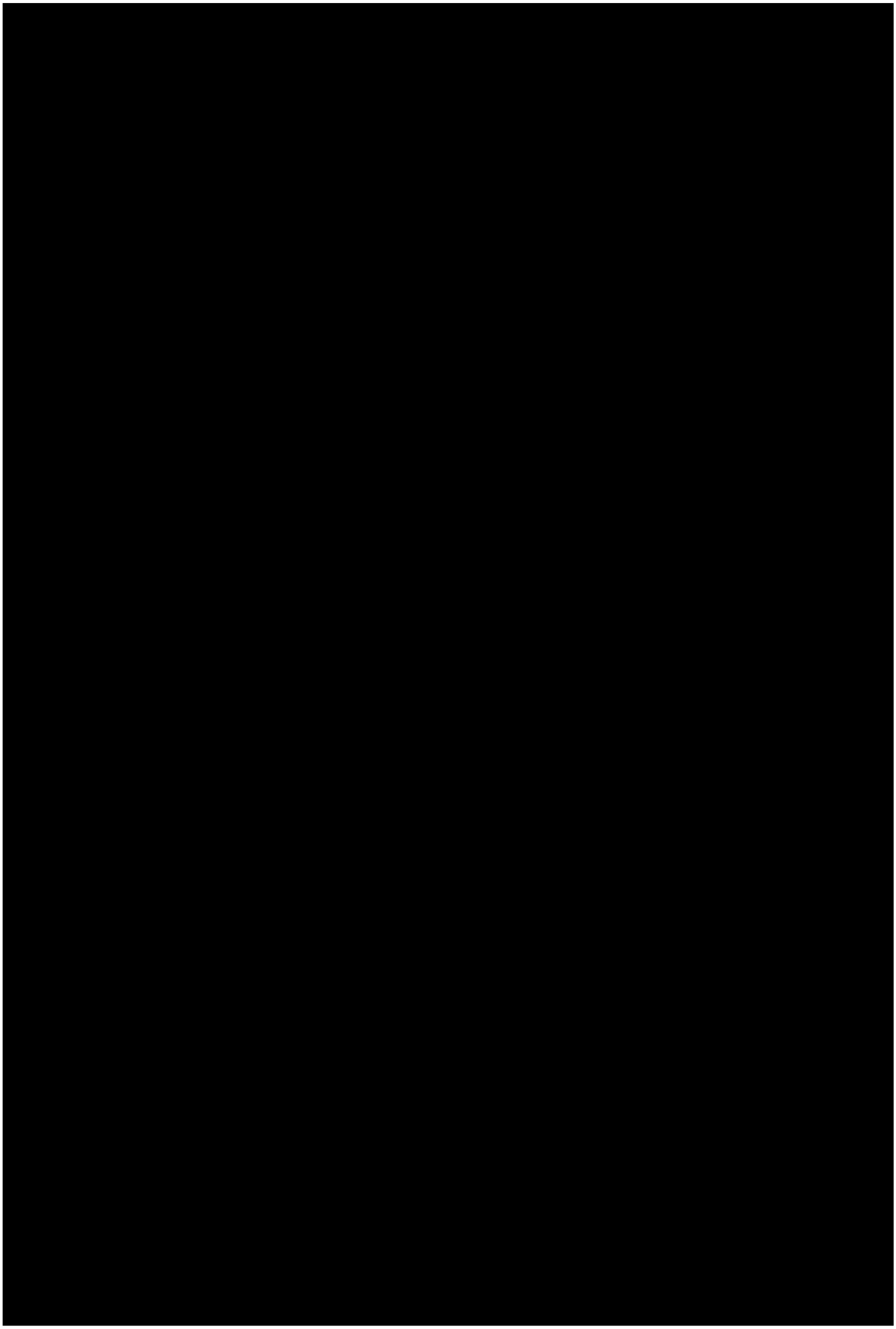
FIG. 5 is a drawing of an absorbent neck shield combined with an apron or bib according to a preferred embodiment of the present invention.

Furthermore, the absorbent neck shield may be combined with other means of preventing leakage and/or contamination. FIG. 5 shows an example of such a combination. In FIG. 5, an absorbent neck shield 500 is attached to a bib 510 in order to provide protection both against any fluids, semi-fluids, and/or fluids and solids from sliding down the neck past the point of the seal and against such materials from contaminating the front portion of the subject. In any embodiments with an attached bib or apron, the bib or apron may take any shape and may be made from any material, or combination of materials, which prevent fluids, semi-fluids, and/or fluids and solids from flowing therethrough.

In a presently preferred embodiment of FIG. 5, the apron portion has an outer surface which can at least partially absorb any contaminants which land on the outer surface so that such materials will not flow off onto other portions of the subject's body. The inner surface of the apron portion (which faces the chest of the subject wearing neck shield/apron combination) is comprised of a material which is at least partially repellent to liquid. By these means, the substances on the outer surface of the apron will not bleed through the material to the clothing of the subject underneath. In other words, the repellent inner surface acts as a barrier.

Figure 7A:
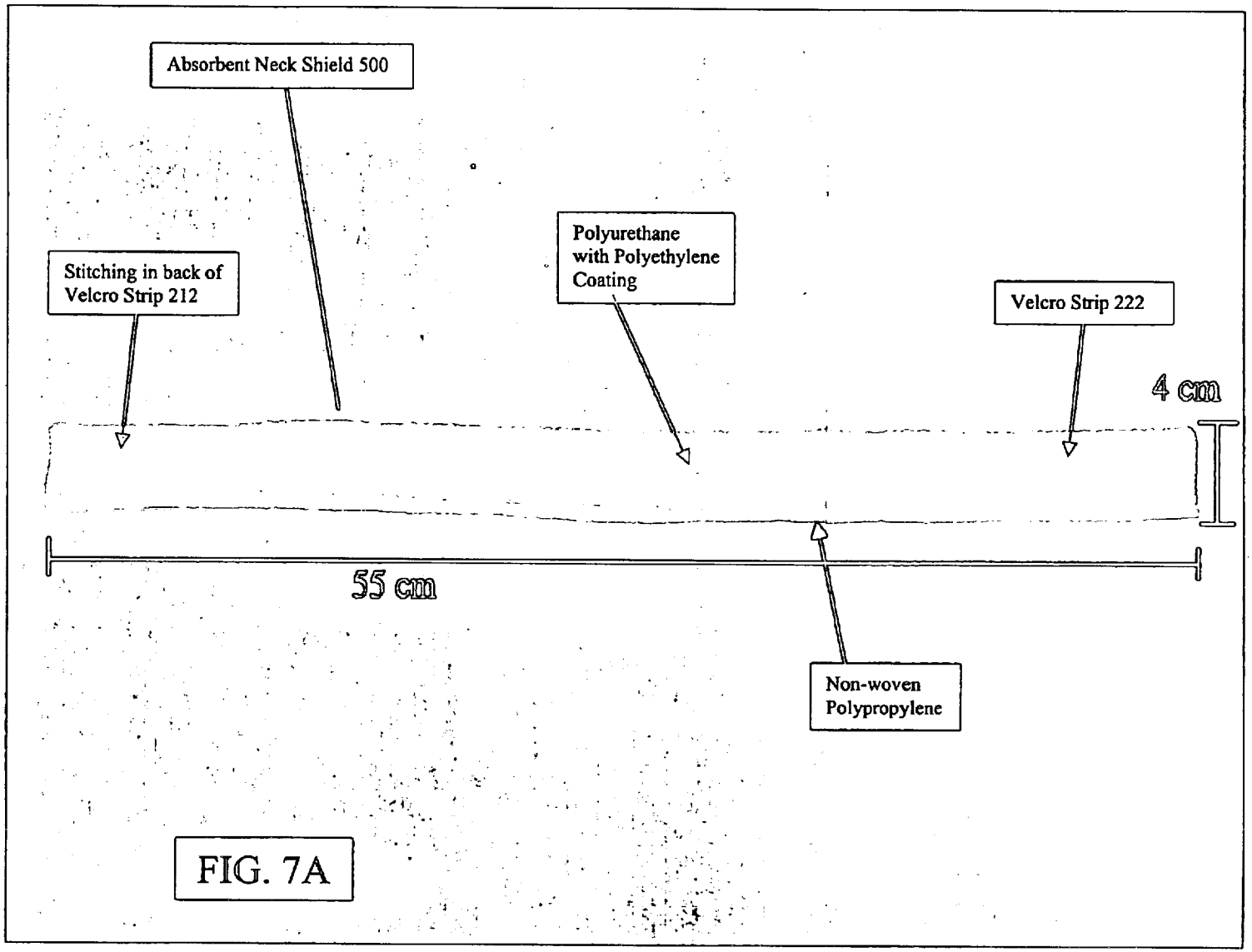
FIG. 7A shows a specific implementation of an absorbent neck shield according to a presently preferred embodiment of the invention.
Figure 7B:
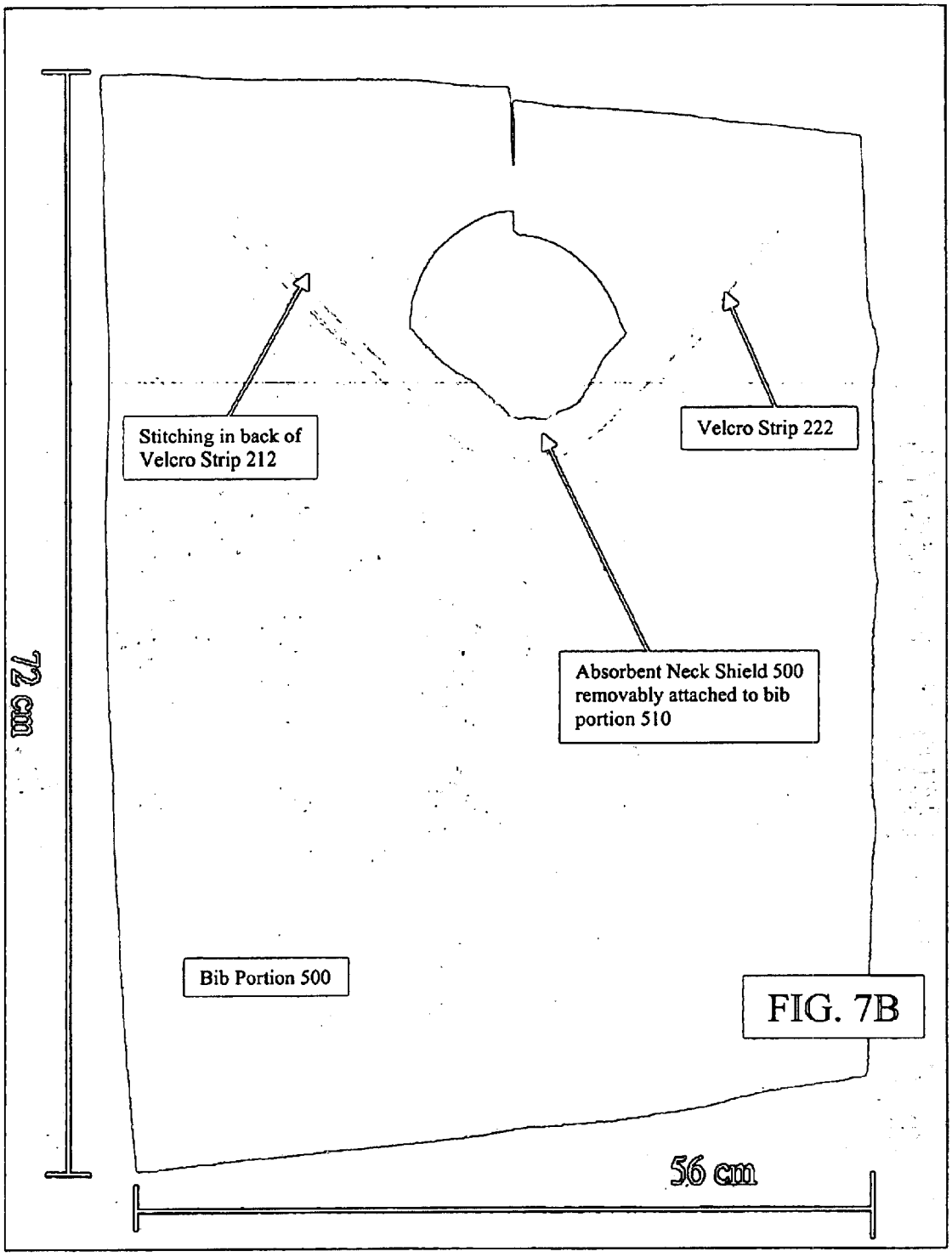
FIG. 7B shows a specific implementation of a combination absorbent neck shield and apron, where the apron is detachable, according to a presently preferred embodiment of the invention.
Figure 7C:
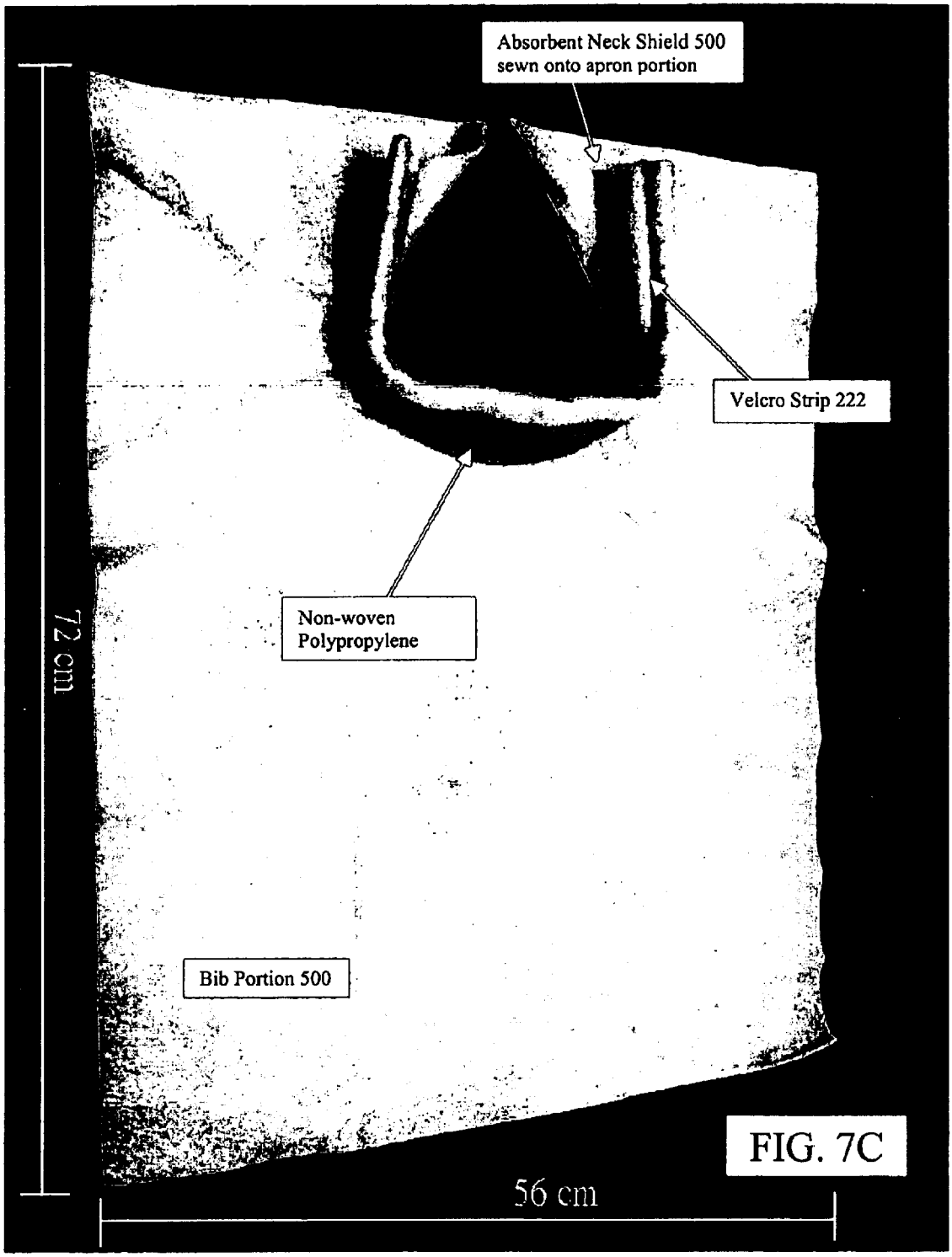
FIG. 7C shows a specific implementation of a combination absorbent neck shield and apron, where the absorbent neck shield is sewn into the apron, according to a presently preferred embodiment of the invention.

FIGS. 7A–7C show specific implementations of the presently preferred embodiment shown in FIG. 5. In FIG. 7A, the absorbent neck shield 500 is shown alone, without the bib 510. In the specific implementation of FIG. 7A, the absorbent material forming the interior of the absorbent neck shield 500 is polyurethane with polyethylene coating, which provides a soft and pleasant feel as well as the absorbent quality required. On the outside (not shown in FIG. 7A) and the bottom section of the absorbent neck shield 500, non-woven polypropylene forms a substantially fluid-Impermeable barrier. The absorbent neck shield 500 shown in FIGS. 7A–7C fastens in the manner shown in FIG. 2A, i.e., by overlapping the two VELCRO™ strips 212 and 222. In FIG. 7A, the surface of VELCRO™ strip 222 can be seen on the right, while only the stitching attaching VELCRO™ strip 212 to the absorbent neck shield 500 can be seen on the left (the VELCRO™ strip 212 itself is on the other side).

FIG. 7B shows a specific implementation of the combination neck shield 500 and bib 510 where the shield 500 and bib 510 are detachably connected to one another. In the specific implementation shown in FIG. 7B, the absorbent neck shield is attached by means of VELCRO™ strips, although any means of removable attachment may be used in accordance with the present invention. In FIG. 7B, the outer surface of bib portion 510 is polyurethane, while the inner surface (not shown) of bib portion 510 (which faces the chest of the subject wearing neck shield/apron combination) has coating of polyethylene. By these means, the substances on the outer surface of bib portion 510 will not bleed through the material to the clothing of the subject underneath.

FIG. 7C shows a specific implementation of the combination neck shield 500 and bib 510 where the shield 500 and bib 510 are permanently connected to one another. In the specific implementation shown in FIG. 7C, the absorbent neck shield is permanently attached by sewing together portions of the absorbent neck shield 500 and bib 510, although any means of permanent attachment may be used in accordance with the present invention. The bib portion 500 in FIG. 7C is the same as the bib portion 500 in FIG. 7B.

One of the preferred uses for the wrap-around neck shield would be for a patient to wear during a dental procedure. However, other uses for the neck shield are contemplated. For example, the combined neck shield and apron could be used on a baby or child, on an adult who is either eating an extremely messy food or engaged in another activity, such as driving, or on a physically or mentally impaired individual. Furthermore, the wrap-around neck shield could be used by hairdressers, barbers, and the like for protecting their customers from fluids, semi-fluids, and/or fluids and solids which may flow down the subject's neck.

The wrap-around shield according to the present invention is not limited to being attached at the neck of a subject. It is intended that the absorbent shield according to the present invention be used in any of the myriad of circumstances in which one may wish to protect a portion of one's body from the flow of fluids from another portion of one's body and/or from the general environment. For example, a wrap-around shield could be used in a dermatological procedure where a chemically active substance is being applied to a portion of one's skin.

As another example, a wrap-around shield according to the present invention could be used to protect a wound and/or a covering of a wound or medical condition, such as a cast, from a generally damp environment, such as when one is outside when it is raining, or an environment where there is a risk of becoming damp, such as when one is boating or perhaps showering. In such an exemplary environment, the wrap-around shield could be combined with an impermeable enclosure, such as a glove, shoe, or plastic bag, which would cover the portion of the body which needs to be protected, such as a bandaged hand or foot. These are only one or two exemplary uses for the present application; the possible applications and variations of the present invention are legion.

Figure 6:
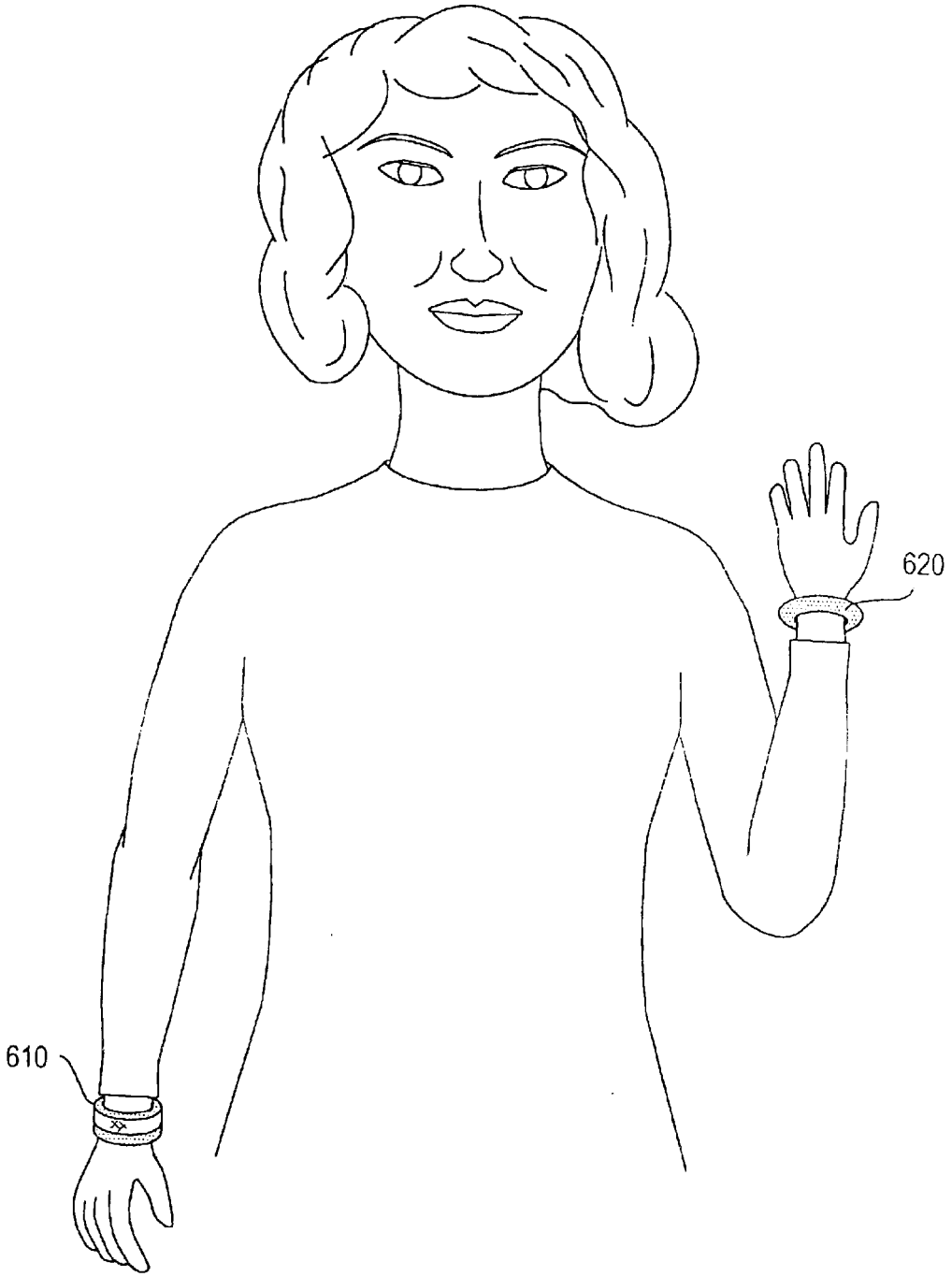
FIG. 6 is a drawing of two wrap-around absorbent arm shields according to a preferred embodiment of the present invention.

As discussed above, although the wrap-around absorbent shield in FIGS. 1–5 is shown fastened to the neck of the subject, a wrap-around absorbent shield according to the present invention can be used on any limb or portion of the subject's body. The embodiment of the present invention shown in FIG. 6 shows an example of such a usage. In FIG. 6, the subject has two wrap-around shields 610 and 620, one on each arm. Different fastening or affixing means may be used in accordance with this embodiment, as is shown by wrap-around shields 610 and 620. Wrap-around shield 610 has fastening/affixing means similar to the embodiments shown in FIGS. 2A and 2B, whereas wrap-around shield 620 has fastening/affixing means similar to the embodiment in FIG. 4, i.e., wrap-around shield 620 is comprised of absorbent, elastic material which forms a semi-tight seal with the flesh of the subject. For a wrist embodiment of the present invention, the elastic embodiment 620 may be preferable, as it would be easier to take on and off.

There may be a variety of uses for the wrap-around wrist shield embodiment of FIG. 6. One use could be for a subject who is washing pots, pans, and dishes. Another possible use would be if the subject is engaged in a fluid-based activity above his head, i.e., the subject is keeping his or her arms above his or her head while performing an activity in which the subject's hands are in contact with any fluids, semi-fluids, and/or fluids and solids which may flow down the subject's arms. Such activities may include washing or cleaning an object, such as a window or the gutters of a house, above the subject's head.

Furthermore, a wrap-around arm shield could be used in instances where protection from contaminated body fluid is important, such as when a phlebotomist is drawing blood from a patient, or when a tattoo artist is inking a body part. In the same vein, a wrap-around shield may be used to isolate an area of infection or seepage from an area of infection on a patient's limb, or around the waist of a patient who has had a colostomy. Further still, a wrap-around shield could be used in combination with an impermeable enclosure, such as a plastic bag or protective glove or shoe, to protect a bandaged limb or a limb with a cast on it; in the case of FIG. 6, the wrap-around wrist shields in FIG. 6 could be combined with a glove or plastic bag that would fit over the subject's hand, if it bore an open wound, a bandage, or a cast.

The appropriate fastening or affixing means for a wrap-around shield depends upon the limb or portion of the body around which the shield will be wrapped and the activities the subject will be engaged in while wearing the wrap-around shield. For example, as indicated above, elasticity may be preferred for wrapping around an arm engaged in cleaning, while Velcro™ strips or a resilient 'backbone' may be preferred for wrapping around a neck.

Furthermore, the wrap-around shield (and/or any attached members) may be lined on the bottom or inside portion with a material, such as plastic, which is impervious to the transmission of any fluids, semi-fluids, and/or fluids and solids. This would help prevent fluids which have saturated the absorbent material of the shield from leaking through the bottom portion of the shield onto the subject or the subject's clothes. The impermeable material could also line the inside of bib or apron 510, or could form a section of the apron 510 between the main section of the apron 510 and the shield 500 (thereby preventing the fluid dripping from a saturated shield 510 from flowing downward to a point where it may seep through to the subject underneath).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A bib for protecting a subject from at least one of fluids, semi-fluids, and a mixture of either fluids or semi-fluids and solids comprising:

a neck portion forming a semi-tight seal with the flesh of the neck of the subject, said neck portion comprising:

an inner surface comprising polyurethane with a polyethylene coating, which forms a semi-tight seal with the flesh of the neck of the subject; and an outer surface comprising non-woven polypropylene;

wherein the combination of the semi-tight seal and absorbency of the inner surface forms a barrier which substantially prevents said at least one of fluids, semi-fluids, and a mixture of either fluids or semi-fluids and solids from flowing onto the flesh of the neck below the semi-tight seal; and an apron portion connected to said neck portion for covering at least a portion of the chest of the subject, said apron portion comprising:

an outer surface comprising polyurethane for preventing said at least one of fluids, semi-fluids, and a mixture of either fluids or semi-fluids and solids from flowing when said at least one of fluids, semi-fluids, and a mixture of either fluids or semi-fluids and solids falls upon said outer surface; and an inner surface comprising polyethlene for preventing fluid on the outer surface of the apron portion from coming through the material of the apron portion and coming into contact with the covered portion of the subject's chest.

2. The bib of claim 1, wherein the apron portion and the neck portion are permanently connected.

3. The bib of claim 1, wherein the bib is used in at least one of a dental procedure, a dermatological procedure, a surgical procedure, a hair care procedure, and a culinary procedure.

4. The bib of claim 1, wherein the apron portion and the neck portion are detachably connected.

5. The bib of claim 1, wherein the neck portion further comprises:

a semi-rigid, resilient member for maintaining a shape which will maintain the semi-tight seal with the subject's neck.

6. The bib of claim 5, wherein the semi-rigid, resilient member is located at least partially inside the neck portion.

7. The bib of claim 5, wherein the semi-rigid, resilient member comprises at least one of a metal and a polymer.

8. The bib of claim 1, wherein the neck portion further comprises:

an elastic material for forming the semi-tight seal with the subject's neck.

9. The bib of claim 1, wherein at least one of the neck portion, the inner surface of the neck portion, and/or the outer surface of the neck portion comprises at least one of sponge and sponge-like material.

10. The bib of claim 1, wherein at least one of the neck portion, the inner surface of the neck portion, and/or the outer surface of the neck portion comprises at least one of absorbent paper and absorbent polymer.

11. The bib of claim 1, further comprising:

means for affixing the neck portion to the subject.

12. The bib of claim 11, wherein the means for affixing comprises:

means for connecting two portions of the neck portion so that the neck portion encircles the subject's neck.

13. The bib of claim 12, wherein the means for connecting two portions of the neck portion comprises at least one of hook and fastener means, at least one button and buttonhole, at least one snap, and/or strips of material which can be tied together.

* * * * *